US005936350A

United States Patent [19]

Yoshida et al.

[11] Patent Number: 5,936,350

[45] Date of Patent: Aug. 10, 1999

[54] METAL HALIDE HEADLAMP

[75] Inventors: Mitsunari Yoshida, Yokohama; Yoshifumi Takao, Sagamihara; Toshiyuki Nagahara, Yokohama, all of Japan

[73] Assignee: Stanley Electric Co., Ltd., Japan

[21] Appl. No.: 09/018,329

[22] Filed: Feb. 4, 1998

[30] Foreign Application Priority Data

Feb. 7, 1997 [JP] Japan ..... 9-025044

[51] Int. Cl.[6] ..... H01J 61/00

[52] U.S. Cl. ..... 313/631; 313/344; 313/638; 313/574; 313/332

[58] Field of Search ..... 313/623, 631, 313/574, 344, 638, 491, 626, 331, 332, 333

[56] References Cited

U.S. PATENT DOCUMENTS 5,107,165 4/1992 Dever et al. ..... 313/331 X 5,847,510 12/1998 Goelling et al. ..... 313/332 X

FOREIGN PATENT DOCUMENTS

| | | |
|---|---|---|
| 0115921 | 8/1984 | European Pat. Off. . |
| 0408981 | 1/1991 | European Pat. Off. . |
| 2445614 | 7/1980 | France . |
| 4342013 | 6/1994 | Germany . |
| 6223781 | 4/1994 | Japan . |
| 1515583 | 6/1978 | United Kingdom . |

*Primary Examiner*—Ashok Patel

*Attorney, Agent, or Firm*—Ostrolenk, Faber, Gerb & Soffen, LLP

[57] ABSTRACT

A metal halide headlamp comprising an electrode and a coil wrapping around said electrode to prevent the occurrence of cracks in a sealing portion, in which the diameter $d_0$ of said electrode, the cross-section S of said electrode including said coil, the inner diameter ID of said coil, the pitch P of said coil, the distance L between an end of said coil and a metal foil, and the amount of metal halides with a NaI-to-$ScI_3$ ratio are specifically limited. Thereby, the prior art problems, i.e., changes in the lamp characteristics, the degradation of durability, and so on, can be solved.

2 Claims, 2 Drawing Sheets

METAL HALIDE HEADLAMP

BACKGROUND OF THE INVENTION

1. Field of the Invention

The present invention relates to a metal halide discharge lamp, and more specifically, to a metal halide headlamp for vehicles, where adjustments, such as a current increasing, are achieved to obtain a predetermined brightness immediately after the lamp is turned on.

2. Background Art

When applying a metal halide lamp 90 shown in FIG. 4 of the type proposed in the present invention as a light source for a headlamp of a vehicle, the following approach has conventionally been adopted: A current that is a few times greater than a rated current for a stable state is passed across a pair of electrodes 91 to increase luminous intensity of the lamp which is insufficient immediately after the lamp is turned on; thereby the metal halide lamp 90 is rapidly heated to attain the stable state quickly.

When the electrode 91 is rapidly heated in the above lighting approach, a problem arises that the thermal expansion of silica glass constituting a sealing portion 92*a* of a bulb 92 cannot comply with the thermal expansion of the electrode 91 so that cracks occur in the sealing portion 92*a*, resulting in a leak failure.

To cope with this problem, a proposal has been made to prevent the occurrence of cracks in the sealing portion 92*a* by wrapping a coil as a buffer around an appropriate area of the electrode 91. In this approach, however, metal halides sealed in the discharge chamber 92*b* of the bulb 92 are accumulated on the coil as time goes, leading to the other problems of changes in the lamp characteristics and the degradation of durability.

Though Japanese Patent Application Laid-open No. Hei 6-223781 discloses an invention, in which beads are attached as a buffer around an electrode, this invention does not allow high precision in the positioning of the electrode and, as a result, cumbersome adjustments are required when installing headlamps. Problems have always remained to be solved in the prior art, regardless of any shapes of the lamp adopted in the prior art.

SUMMARY OF THE INVENTION

An object of the present invention to solve the problems in the above-stated prior art is to provide a metal halide headlamp in which a coil is wrapped around an electrode installed in a discharge chamber to prevent the occurrence of cracks in a sealing portion, characterized in that the diameter $d_0$ of the electrode is adjusted so that current density becomes no less than 9.5 A/mm$^2$ and no more than 181 A/mm$^2$; the cross-section S of the electrode including the coil is no more than 0.2 mm$^2$; the inner diameter ID of the coil is no less than $d_0$ and no more than $1.5\times d_0$; the pitch P of the coil is less than 600%; the distance L between an end of the coil and the metal foil is no less than 0.2 mm; and 0.2~0.4 mg of metal halides with an NaI-to-$ScI_3$ ratio within the range between 4:1 and 2:1 are sealed in the discharge chamber.

DETAILED DESCRIPTION OF THE PREFERRED EMBODIMENTS

Figure 1:
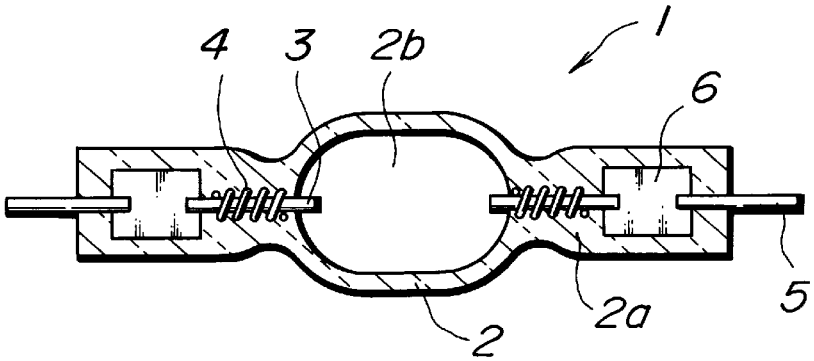
FIG. 1 is a cross-sectional view showing an embodiment of the metal halide headlamp according to the present invention.

The present invention will be described in detail hereinafter based on an embodiment shown in FIG. 1. Reference numeral 1 designates a metal halide headlamp according to the present invention which is similar to conventional ones in having a bulb 2 comprising sealing portions 2*a* and a discharge chamber 2*b* in the center portion thereof, a pair of electrodes 3 extending from the respective sealing portions 2*a* to the discharge chamber 2*b*, coils 4 that wrap around the respective electrodes 3, and metal foils 6 connected with the respective electrodes 3 and lead-in wires 5 sealed within the sealing portion 2*a*.

According to the present invention, the occurrence of cracks in the bulb 2 and changes in the lamp characteristics caused by the accumulation of metal halides on the coils 4 after the lamp 1 is turned on can be prevented by optimally setting the conditions of the electrodes 3, the coils 4, and other parts constituting the metal halide headlamp 1.

As explained above, the electrodes 3 are subjected to be fed a few times the rated current immediately after the lamp is turned on so that a stable state can be quickly attained by the generated heat. Depending on the ambient temperature, 3~8 times the rated current may be normally fed to the electrode.

Even when three times the rated current, which is the minimum value in the above-cited range, is fed to the electrode 3, sufficient heat must be generated to attain the stable state quickly. The results of an experiment conducted in association with the present invention indicate that a current density of D=9.5 A/mm$^2$ or greater in the electrodes 3 is required for this purpose.

When the rated voltage and current of the 35-W metal halide lamp 1 are 87 V and 0.4 A, respectively, for the stable state, three time the rated current becomes 1.2 A. In this case, the diameter of the electrode 3 may be $d_0$=0.4 mm or less to satisfy the above-stated current density.

Current density, D, increases when the electrode diameter, $d_0$, is decreased; in other words, the rate of temperature rise is increased so that the stable state is attained quickly. However, excessive heating may lead to the fusing of the electrode 3. This condition corresponds to a current density of D=181 A/mm$^2$, which means the electrode diameter of the metal halide headlamp 1 may be $d_0$=0.15 mm or greater.

In the present invention, the stable state should be attained quickly by heating under the condition that the coil 4 is attached to the electrode 3. The results of the inventors' experiment indicate that this can be attained when the cross-section of the electrode 3 including the coil 4 may be S=0.2 mm$^2$ or smaller.

Figure 2:
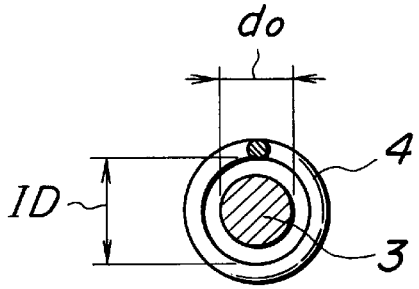
FIG. 2 is a cross-sectional view showing the relationship between the electrode diameter and the coil inner diameter in the embodiment.

The relationship between the diameter $d_0$ of the electrode 3 and the inner diameter ID of the coil 4 is shown in FIG. 2. The results of the inventors' experiment indicate that metal halides are accumulated between the electrode 3 and the coil 4 when ID is increased in reference to $d_0$, and changes in the lamp characteristics become more prominent as time goes by after the lamp is turned on.

In the present invention, 0.2~0.4 mg of metal halides with an NaI-to-$ScI_3$ ratio within the range between 4:1 and 2:1 are sealed in the discharge chamber 2*b* so that a lumen maintenance factor of 70% is obtained 1,000 hours after the lamp is turned on and, at the same time, the inner diameter ID of the coil 4 may be preferably adjusted within the range between $d_0$ and $1.5 \times d_0$. As a result, the lamp can serve for practical use.

Figure 3:
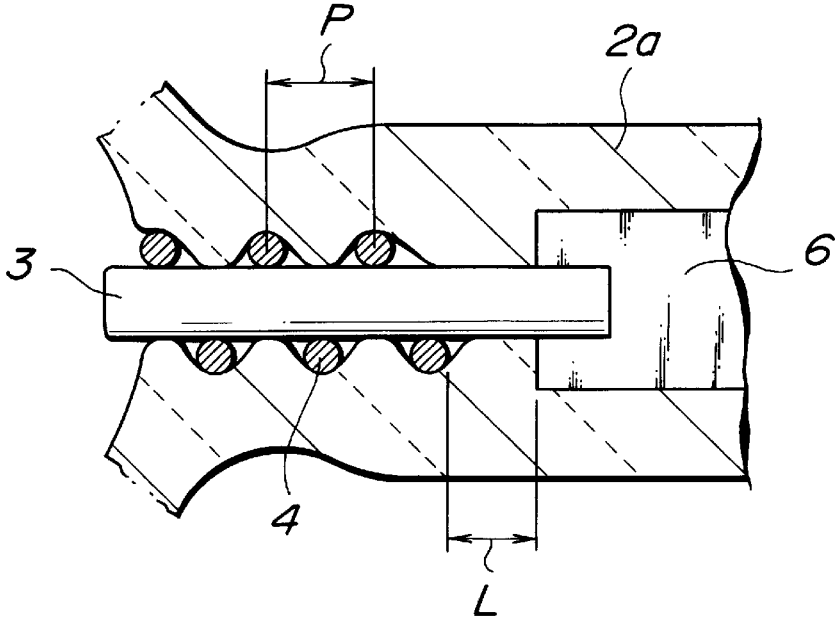
FIG. 3 is a cross-sectional view showing the relationship between the electrode and the coil pitch in the embodiment.
Figure 4:
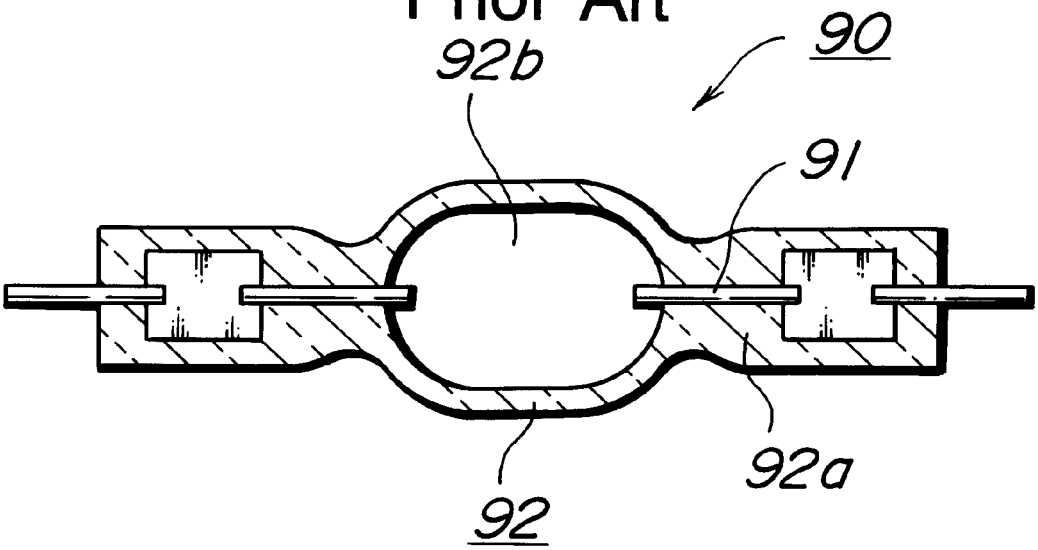
Fig. 4 Prior Art
FIG. 4 is a cross-sectional view showing an example of the prior art.

The pitch P of the coil 4 in relation to the electrode 3 is shown in FIG. 3. If the pitch P is too large during sealing, the glass constituting the sealing portion 2*a* will squeeze into the space between the windings of the coil 4 and become in contact with the electrode 3. This will lead to the occurrence of cracks in the sealing portion 2*a* when a large current is provided immediately after the lamp is turned on, and will reduce the effectiveness of installing the coil 4.

The pitch P of the coil 4 is designated to be less than 600% in the present invention because the results of the inventors' experiment indicate that the above-mentioned occurrence of cracks can be prevented as a result. Here, P is given by:

(distance between the respective center lines of the wires/wire diameter of the coil 4)×100%.

More preferably, the pitch P is designed to be no more than 300%.

As depicted in FIG. 3, the present invention also designates that the distance between an end of the coil 4 and the metal foil 6 be L=0.2 mm or greater. The results of the inventors' experiment indicate that the peeling of the metal foil 6 from the sealing portion 2*a* and a resulting leak failure can be prevented by this designation.

Effect of the Invention

The metal halide headlamp of the present invention possesses the following characteristics: the diameter $d_0$ of the electrode is adjusted so that current density becomes no less than 9.5 A/mm$^2$ and no more than 181 A/mm$^2$; the cross-section S of the electrode including the coil is no more than 0.2 mm$^2$; the inner diameter ID of the coil is no less than $d_0$ and no more than $1.5 \times d_0$; the pitch P of the coil is less than 600%; the distance L between an end of the coil and the metal foil is no less than 0.2 mm; and 0.2~0.4 mg of metal halides with an NaI-to-$ScI_3$ ratio within the range between 4:1 and 2:1 are sealed in the discharge chamber. With this invention, leakage is prevented when excessive current is fed immediately after the lamp is turned on to achieve a stable state. Also, changes in the lamp characteristics caused by the accumulation of metal halides on the coil can be suppressed. Accordingly, this invention brings about superbly advantageous effects.

What is claimed is:

1. A metal halide headlamp comprising a bulb having a sealing portion and a discharge chamber in the center portion thereof, an electrode extending from the sealing portion to the discharge chamber, a coil that wraps around said electrode to prevent the occurrence of cracks in the sealing portion, a metal foil connected with the electrode and sealed within the sealing portion, and a lead-in wire sealed within the sealing portion, characterized in that the diameter $d_0$ of said electrode is adjusted so that current density becomes no less than 9.5 A/mm$^2$ and no more than 181 A/mm$^2$;

the cross-section S of said electrode including said coil is no more than 0.2 mm$^2$;

the inner diameter ID of said coil is no less than $d_0$ and no more than $1.5 \times d_0$;

the pitch P of said coil is less than 600%;

the distance L between an end of said coil and a metal foil is no less than 0.2 mm; and 0.2~0.4 mg of metal halides with a NaI-to-$ScI_3$ ratio within the range between 4:1 and 2:1 are sealed in said discharge chamber.

2. A metal halide headlamp according to claim 1, wherein the pitch P of said coil is less than 300%.

* * * * *